United States Patent [19]

Christensen

[11] 4,369,904

[45] Jan. 25, 1983

[54] SCABBARD FOR FIREARMS

[76] Inventor: George L. Christensen, 626 N., 1st West, Tremonton, Utah 84337

[21] Appl. No.: 264,645

[22] Filed: May 18, 1981

Related U.S. Application Data

[63] Continuation-in-part of Ser. No. 32,518, Apr. 23, 1979, abandoned.

[51] Int. Cl.[3] ..... F41C 27/00

[52] U.S. Cl. ..... 224/250; 224/913; 150/1.5 R

[58] Field of Search ..... 224/232, 234, 235, 250, 224/911, 913; 150/1.5 R, 12, 28 R

[56] References Cited

U.S. PATENT DOCUMENTS

| | | | |
|---|---|---|---|
| 931,627 | 8/1909 | Lszarovich | 150/28 R |
| 1,092,729 | 7/1914 | Law | 150/1.5 R |
| 2,524,639 | 10/1950 | Saunders | 224/250 |
| 2,789,571 | 4/1957 | Kurman | 150/12 |
| 3,142,424 | 7/1964 | Reed | 224/913 |
| 3,295,643 | 1/1967 | Peterson | 150/28 R |

FOREIGN PATENT DOCUMENTS

| | | | |
|---|---|---|---|
| 9204 | 7/1933 | Australia | 150/1.5 R |
| 18657 | of 1907 | United Kingdom | 224/913 |

*Primary Examiner*—Herbert F. Ross

*Attorney, Agent, or Firm*—Edward E. McCullough

[57] ABSTRACT

An elongated tube that is open at one end and tapers to a closed end has an elongated stiffener or spine fastened inside the tube. The stiffener is sufficiently wide to maintain the normally flat tube in an open position and to provide anchor means for straps used to provide attachments of the scabbard to other equipment. A short, flexible sleeve is attached to the open end of the elongated tube, and a drawstring is threaded into the outer end of the flexible sleeve for closing it.

10 Claims, 5 Drawing Figures

SCABBARD FOR FIREARMS

This application for patent is a continuation-in-part of patent application Ser. No. 032,518, titled "Scabbard for Firearms," by George L. Christensen, filed Apr. 23, 1979, now abandoned.

BACKGROUND OF THE INVENTION

A. Field of the Invention

This invention relates broadly to protective means for elongated firearms. It especially relates to such scabbards having stiffening means that performs a plurality of functions simultaneously and that have special closure means that is especially advantageous for use with open vehicles.

B. Description of the Prior Art

Conventional scabbards for elongated firearms, such as hunting guns, are normally unsupported by stiffening means and are shipped and stored in a flat condition. This promotes formation of molds and mildews inside the scabbards because of the lack of air circulation, especially when in moist climates. Another disadvantage of the prior art scabbards is that two hands are required for insertion of a firearm, since one hand must be used to hold the scabbard open during the insertion. This can be a handicap when the operator must simultaneously handle other operations or apparatus, such as the reins of a horse's harness. Also, they lack convenient end closure means for protecting the firearm from dust when the scabbards are attached to open vehicles, such as motorcycles.

SUMMARY OF THE INVENTION

The present invention, which overcomes these disadvantages of the prior art, is essentially a flattened tube, open at one end and closed at the other. At one longitudinal edge of the tube, the two flat sides thereof are spaced apart by a spine-like stiffener that is fastened inside the tube and extends for approximately the length of the tube. In cross section, the tube forms an isosceles triangle having a short base created by the stiffener.

The primary object of the stiffener was to solve manufacturing problems. When it was fastened to the center of a flat piece of leather, or similar material, it was found that the scabbard could be formed simply by sewing the peripheral edges of the material together, except for those forming the open end. Use of the stiffener prevented twisting of the material, which was otherwise a major problem; and it eliminated the need for a mold upon which to form the scabbard. Also, it provided a useful handling means for the scabbard material.

However, it was then discovered that the use of the stiffener also produced several other unexpected and beneficial results: (1) It maintained the scabbard open to circulation of air during storage and transportation, so that formation of fungus growths therein is inhibited; (2) It facilitates insertion of a firearm therein, especially by one hand; (3) It provides structural support for the scabbard; and (4) It provides reinforcement means for retaining straps for fastening the scabbard to other equipment, such as motorcycles, etc. Hence, these are considered to be further objects of the invention. A short, flexible sleeve is attached to the open end of the elongated tube and has a drawstring in its outer end for easy closure to protect the firearm from dust and sand when the scabbard is used with open vehicles or with horses.

Other objects and advantages of the invention will be noted as the following, detailed description is read with reference to the accompanying drawings. The same part numbers refer to the same parts throughout the disclosure.

DESCRIPTION OF THE PREFERRED EMBODIMENTS

Figures 1, 2, 3, 4, 5:
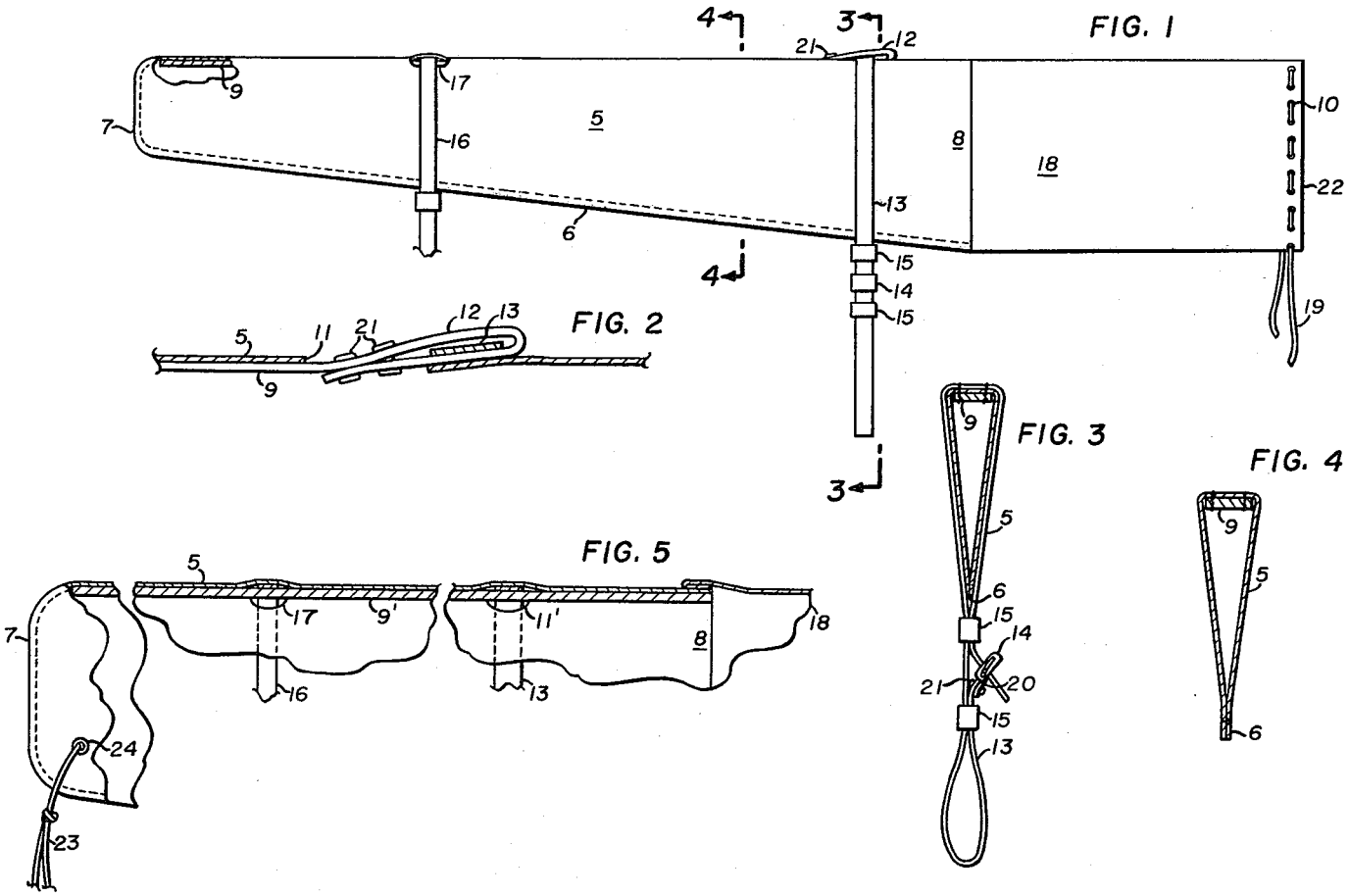
FIG. 1 is a side elevation of the invention.
FIG. 2 is a fragmentary section of an anchor loop.
FIG. 3 is a section taken on line 3—3 of FIG. 1 to show the arrangement of the fastening straps.
FIG. 4 is a cross section taken on line 4—4 of FIG. 1.
FIG. 5 is a fragmentary section of a second embodiment of the invention.

As shown in FIG. 1, the invention has a flattened, elongated tube 5, having two flat sides. In a preferred embodiment, this tube 5 is made of a single piece of semirigid material, such as leather or vinyl, folded upon itself. The longitudinal edges 6 are then fastened together by sewing, as are the edges of the closed end 7. The opposite end 8 is open and, in a preferred embodiment, the tube 5 tapers therefrom to a much smaller closed end 7.

A long, spine-like stiffener 9 is fastened to the inside of the tube 5 along the longitudinal edge thereof opposite the edges 6 that are sewn together. The stiffener 9 is of the same material as the tube 5, preferably, but is much thicker and more rigid. It is wide enough to maintain the tube 5 in an open position to permit circulation of air therein and to facilitate the insertion of a firearm. It may be fastened into the tube 5 by any of various means, but a preferred means is by stitching (FIG. 4). The end portion of the stiffener 9 adjacent the open end 8 passes through an opening 11 in the tube 5 and folds upon itself to form a loop 12 (FIG. 2). In cross section, the scabbard has the appearance of an isosceles triange having a very short base formed by the stiffener 9.

A first strap 13 passes through a loop 12 and around the tube 5 and is equipped with a buckle 14 or other fastening means for fastening the tube 5 to other equipment (FIG. 3). Slides 15 may be used to keep the strap 13 snug about the tube 5 and the equipment to which it is fastened. A second strap 16 passes through an opening 17 in the tube 5 adjacent the stiffener 9. It is also equipped with a buckle 14 and, optionally, slides 15 for the same purpose as those of the strap 13. By this means, the stiffener 9 functions as a reinforced retaining means for the straps 13 and 16.

A short, flexible sleeve 18, preferably made of a soft material, such as suede leather, is fastened to the open end 8 of the tube 5. In a preferred embodiment, a drawstring 19 is fastened into the outer edge portion 18*a* of the flexible sleeve 18 for closing it about the butt end of a firearm. This flexible sleeve 18 is useful for preventing dust and sand from entering the tube 5 as it is carried on open conveyances, such as motorcycles or horses. A considerable variety of means for closing the sleeve 18 could be used in lieu of the drawstring 19. These include zippers of various types, snap fasteners, etc.

In a preferred embodiment, the loop 12 on the stiffener 8 and the loops 20 on the straps 13 and 16 are fastened together by rivets 21.

The drawstring 19 may be installed in the outer edge portion of the flexible sleeve 18 by passing it through a series of openings 10 in the outer end, or, alternatively, the outer edge portion 22 may be folded upon itself and sewn to form a circumferential tube through which the drawstring 19 may be passed. Also, the opening provided by the outer edge 18*a* of the flexible sleeve 18 may be greatly enlarged and a combination of closing means may be used. This drawstring 19 may be made of any number of flexible materials, such as leather, nylon, polypropylene, etc.

A second embodiment of the invention is shown in FIG. 5. This form of the invention incorporates all of the elements of that shown in FIG. 1, except that the loop 12 is eliminated and the stiffener 9' is made to extend to the full length of the tube 5. The opening 11 is modified to resemble the opening 17. Also, a lace 23 is installed in an eyelet 24 in the small-end portion 7 of the tube 5, as an auxilliary fastening means.

The invention is used for its intended purpose by first loosening the drawstring 19 in the short, flexible sleeve 18, and then inserting the firearm, barrel first, until the tip of the barrel reaches the closed end 7 of the tube 5. The sleeve 18 is closed by tightening and tying the drawstring 19. The scabbard is then attached to parts of the vehicle or saddle, not shown, by means of the straps 13 and 16 and the lace 23.

An invention has been described that provides an advance in the art of protective equipment for firearms. Although the embodiments have been described specifically with regard to detail, it should be noted that many details may be altered without departing from the scope of the invention, as it is defined in the following claims.

The invention claimed is:

1. A scabbard for firearms, comprising:

a flattened, elongated tube having two substantially flat sides and having a closed end and an open end, and having a second opening at one edge of the tube intermediate the ends;

an elongated, spine-like stiffener permanently fastened to the inside of the tube at said edge thereof, approximately coextensive with the length of the tube and wide enough to space the two flat sides apart sufficiently to provide open space within the tube said stiffener having a loop at one end thereof extending outwardly through said second opening, a third in said one edge of said tube and large enough to provide an opening on each side of said tube so as to straddle said stiffener; and a pair of straps passing around the tube with one through said third opening and the other through said loop for fastening the scabbard to other equipment.

2. The scabbard of claim 1 further including means on the strap for fastening it to other equipment.

3. The scabbard of claim 1 wherein the tube is tapered so that its closed end is smaller than its open end.

4. The scabbard of claim 1 wherein the tube is a single piece of semirigid material sewn together along its longitudinal edges and around the closed end thereof.

5. The scabbard of claim 1 wherein the stiffener is installed by sewing.

6. The scabbard of claim 1 wherein the tube is made of leather.

7. The scabbard of claim 1 further including a short, flexible sleeve fastened to the open end of the tube in alignment therewith, and means in the outer end portion of the flexible sleeve for closing it.

8. The scabbard of claim 7 wherein the means for closing the flexible sleeve is a drawstring.

9. The scabbard of claim 1 wherein the width of the stiffener is approximately equal to the width of a firearm intended to be enclosed in the scabbard, to facilitate insertion of the firearm into the scabbard.

10. A scabbard for long firearms comprising:

an elongated tube having an open end and tapering to a closed end, said tube being flattened in configuration and formed by folding a single piece of sheet material upon itself and fastening the peripheral edges together along the longitudinal edges and closed end thereof, and said tube having a second opening in the edge thereof opposite the fastened edges;

an elongated stiffener fastened inside the tube adjacent said second opening and having a loop at its outer end, the stiffener being wide enough to insure that open space is maintained within the tube, and said loop extending outwardly through a third opening in the tube adjacent the stiffener;

a pair of straps passing around the tube for fastening the scabbard to other objects, one of said straps passing through said loop in the stiffening member outside said tube and the other of said straps passing through said second opening in the tube between the tube wall and said stiffener;

fastening means on the straps for fastening them to other objects;

a short, flexible sleeve fastened to and aligned with the open-end portion of the tube; and a drawstring in the outer end portion of the flexible sleeve for closing it.

* * * * *